US006679237B1

(12) United States Patent
Skinner et al.

(10) Patent No.: US 6,679,237 B1
(45) Date of Patent: Jan. 20, 2004

(54) IGNITION DRIVE CIRCUIT

(75) Inventors: Albert Anthony Skinner, Anderson, IN (US); Ronald J. Kiess, Decatur, IN (US); Raymond O. Butler, Jr., Anderson, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/213,802

(22) Filed: Aug. 6, 2002

(51) Int. Cl.[7] ..... F02P 00/00
(52) U.S. Cl. ..... 123/643; 123/650; 123/651
(58) Field of Search ..... 123/605, 621, 123/598, 597, 634, 643, 648, 650, 651, 637

(56) References Cited

U.S. PATENT DOCUMENTS

| | | | | | |
|---|---|---|---|---|---|
| 4,403,593 | A | * | 9/1983 | Piteo | 123/406.56 |
| 5,191,531 | A | * | 3/1993 | Kurosu et al. | 701/103 |
| 5,329,902 | A | * | 7/1994 | Sakamoto et al. | 123/257 |
| 5,420,780 | A | * | 5/1995 | Bernstein et al. | 363/89 |
| 5,456,241 | A | * | 10/1995 | Ward | 123/598 |
| 5,558,071 | A | * | 9/1996 | Ward et al. | 123/598 |
| 5,638,799 | A | | 6/1997 | Kiess et al. | 123/637 |
| 5,692,484 | A | | 12/1997 | Downey | 123/643 |
| 5,886,476 | A | | 3/1999 | Skinner et al. | 315/209 T |
| 6,196,208 | B1 | * | 3/2001 | Masters | 123/597 |

OTHER PUBLICATIONS

P. Rault, "SCR's and triacs in automotive applications," SCS–Thomson Microelectronics, Application Note, AN871/0397 Ed: 1 (1997), pp. 1–9.

"Thyristors Silicon–Controlled Rectifiers," Motorola Semiconductor Technical Data, Motorola, Inc. 1999, MCR218 Series, pp. 1–4.

* cited by examiner

*Primary Examiner*—Hieu T. Vo
*Assistant Examiner*—Johnny H. Hoang
(74) *Attorney, Agent, or Firm*—Jimmy L. Funke

(57) ABSTRACT

A drive circuit for an ignition system includes an ignition coil and spark plug associated with each cylinder of an internal combustion engine. Each ignition coil has a primary winding with the first end connectable to a power source and a second end opposite the first end connected to a silicon-control rectifier (SCR). Each coil also has a secondary winding connectable to a respective spark plug. The SCR may be integrated with the coil. A main driver device is connected between the other end of the SCR and ground. The driver device is configured to conduct a primary current in response to a drive signal. The SCRs are controlled into conduction by a respective gating signal. A control circuit is configured to generate the gating signals and the drive signal in response to one or more ignition control signals. An SCR for each coil is used to select which coil is allowed to carry current when the main driver is turned on. This allows the use of a single driver device, and multiple SCRs as selectors, thereby reducing the cost of the drive circuit since SCRs are less expensive.

2 Claims, 5 Drawing Sheets

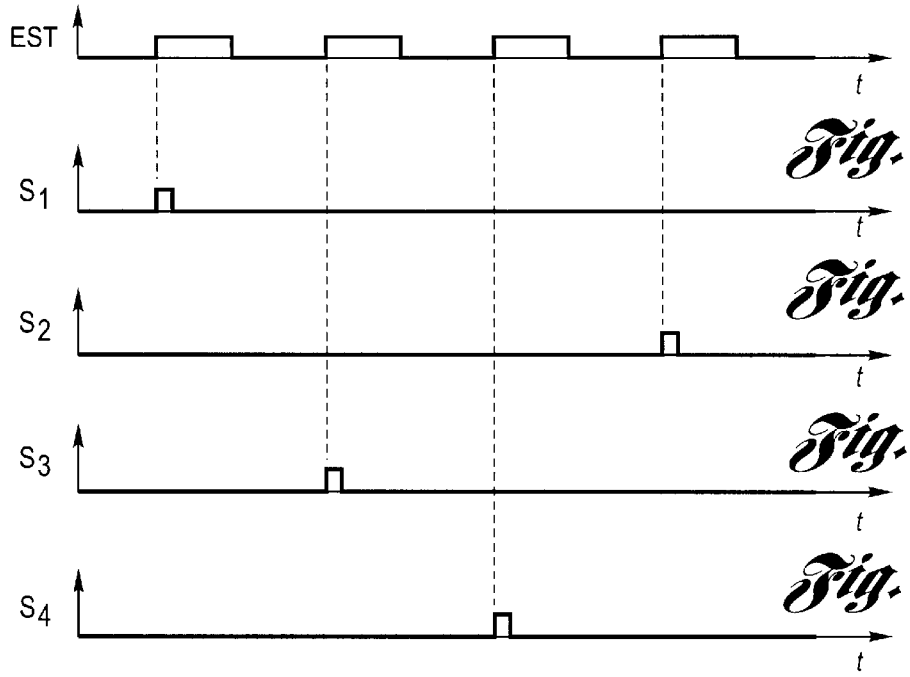
Fig. 2A
Fig. 2B
Fig. 2C
Fig. 2D
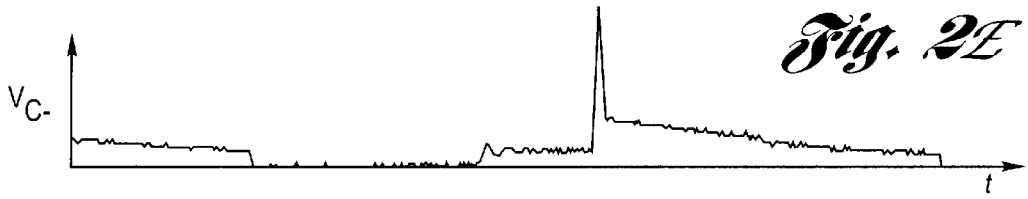
Fig. 2E
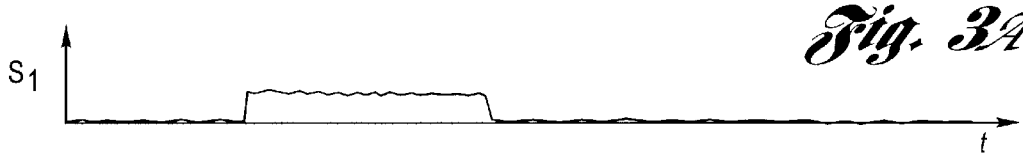
Fig. 3A
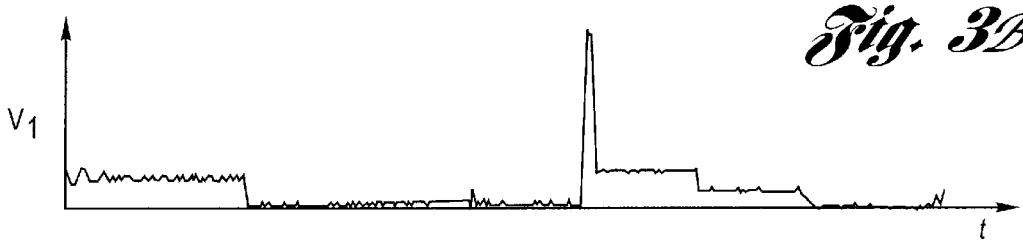
Fig. 3B
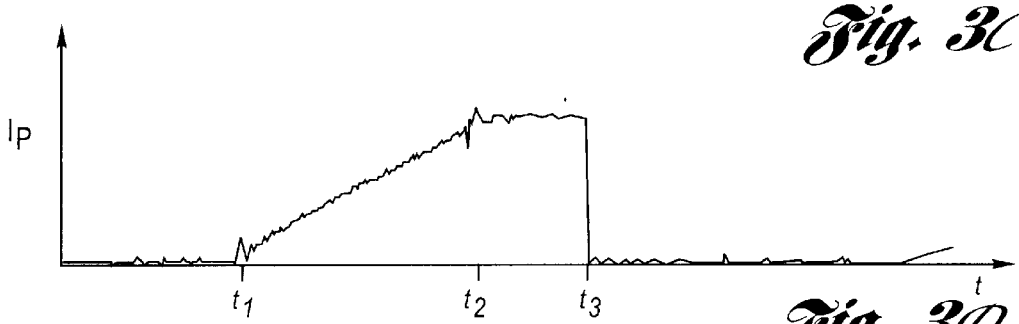
Fig. 3C
Fig. 3D

IGNITION DRIVE CIRCUIT

BACKGROUND OF THE INVENTION

1. Technical Field

The present invention relates generally to spark ignition systems, and, more particularly, to a drive circuit therefor.

2. Description of the Related Art

Conventional ignition systems for producing a combustion arc across electrodes of a spark plug disposed within a combustion chamber are known, as seen by reference to U.S. Pat. No. 5,692,484 issued to Downey. Downey discloses an inductive ignition system for a multiple cylinder internal combustion engine having an individual ignition coil and spark plug associated with each cylinder, each ignition coil having a primary winding with a first end connected to a power source and a second end, wherein each coil further has a secondary winding connected to a respective spark plug. Downey further discloses a driver device for each coil, particularly an insulated gate bipolar transistor (IGBT) connected between the second end of the primary winding and ground. Thus, Downey discloses an individual driver device for each coil included in the ignition system. An important characteristic of the driver device disclosed in Downey is that each driver device can be independently controlled so as to initiate and discontinue the primary current that flows through the primary winding. Although the drive arrangement disclosed in Downey performs satisfactorily, the driver device, including the associated resistors, capacitors, and voltage clamp devices required for proper implementation results in a relatively costly drive circuit. Moreover, when a well-known darlington is used as the driver device, an additional component, namely a reverse voltage protection component (e.g., an in-line diode disposed in the positive voltage rail supplying the ignition circuit) must further be included, thereby further increasing the cost of the drive circuit.

Less costly current-carrying devices are known, such as silicon-controlled rectifiers (SCR), which are known for use as switches in capacitive (i.e., not inductive) discharge style ignition systems. It is also known to use a bi-directional current carrying device, such as a TRIAC, as seen by reference to U.S. Pat. No. 5,638,799 issued to Kiess et al., also for use in a capacitive (i.e., not inductive) discharge ignition system.

There is therefore a need to provide an improved ignition drive circuit that overcomes one or more of the shortcomings as set forth above.

SUMMARY OF THE INVENTION

One object of the present invention is to provide a solution to one or more of the above identified problems. One advantage of the present invention is that it provides a reduced cost ignition system, particularly a reduced cost drive circuit therefor. The invention achieves this by using one main driver for multiple ignition coils rather than multiple drivers. The invention instead uses more cost effective SCRs in each "leg"(i.e., primary circuit) of the ignition coils as selectors. Another advantage of the present invention is that it reduces or eliminates many of the external components typically required in an ignition drive circuit, such as, for example only, a reverse voltage component, a voltage clamp component, and resistors and capacitors associated with what would otherwise be the added driver devices (but now are not needed). This reduces both component and assembly costs. In yet another embodiment, the main driver is integrated up into a vehicle control module, such as an Engine Control Module (ECM), while the SCRs are integrated in their respective ignition coils. This allows the ECM to provide drive capability and save significant space.

An apparatus according to the invention is provided, suitable for use with an inductive ignition system of a multiple cylinder internal combustion engine having an individual ignition coil and spark plug associated with each cylinder. Each ignition coil has a primary winding with a first end configured for connection to a power source and a second end. Each ignition coil further has a secondary winding configured for connection to a respective spark plug. The apparatus comprises multiple silicon-controlled rectifiers (SCRs), a main driver and a control circuit. An SCR is connected to each ignition coil at the second end of the primary winding, each SCR being controllable into conduction by receipt of a respective gating signal. The other end of each SCR is connected to a common node. The main driver is connected to the SCRs (i.e., at the common node) and is configured to conduct a primary current in response to a drive signal. A control circuit generates the gating signals and the drive signal in timed relationship with each other.

In a preferred embodiment, the main driver is integrated into a vehicle control module, such as an ECM, and the SCRs are integrated with the ignition coils (though this is not necessary). The SCRs are used to select which coil is allowed to carry current when the main driver is turned on. This allows the use of a single main driver, and multiple SCRs as selectors. The SCR also acts as a current block for a reverse battery condition, allowing the use of a darlington transistor component as the main driver without having to add a reverse voltage component, such as diode. As an optional preference, where the main driver may comprise an insulated gate bipolar transistor (IGBT), the use of SCRs allows omitting a voltage clamp (e.g., a zener diode) device on the driver.

BRIEF DESCRIPTION OF THE DRAWINGS

The present invention will now be described by way of example, with reference to the accompanying drawings, in which:

FIGS. 3A–3D are waveform diagrams of various output signals of the circuit of FIG. 1.

FIGS. 6A–6C are simplified timing diagrams of a drive signal, and gating signals for use with the embodiment of FIG. 5.

FIG. 7 is a simplified schematic and block diagram view of a third embodiment according to the invention, having the main driver integrated with an ECM.

DETAILED DESCRIPTION OF THE PREFERRED EMBODIMENTS

Figures 1, 4:
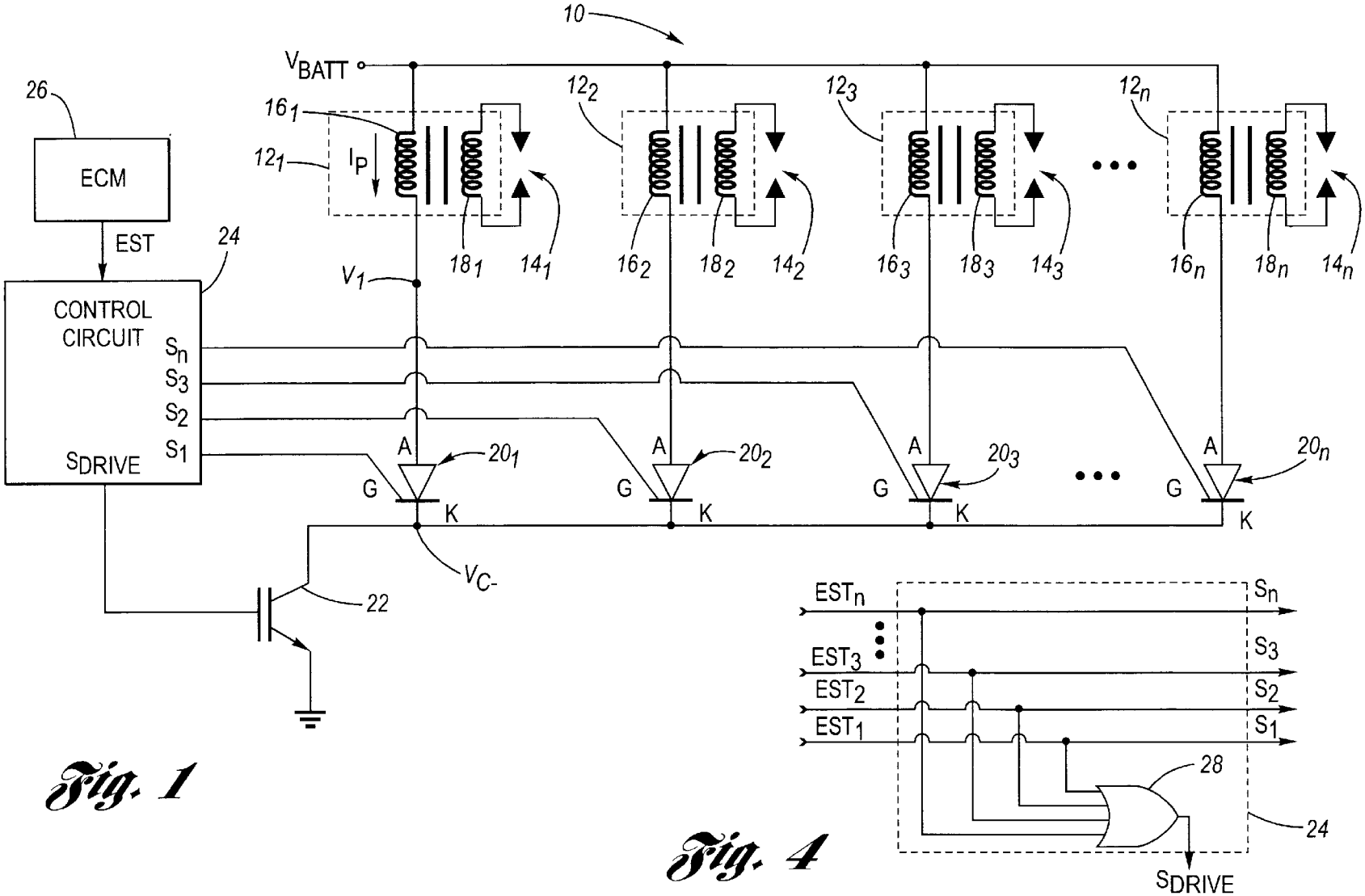
FIG. 1 is a simplified schematic and block diagram view of an a first embodiment of an ignition system according to the invention.
FIG. 4 is a schematic diagram showing, in greater detail, one embodiment of the control circuit of FIG. 1.

FIG. 1 shows an apparatus 10 for an ignition system of a multiple cylinder internal combustion engine (not shown) having an individual ignition coil $\mathbf{12}_1$, $\mathbf{12}_2$, $\mathbf{12}_3$ . . . $\mathbf{12}_n$, and spark plug $\mathbf{14}_1$, $\mathbf{14}_2$, $\mathbf{14}_3$ . . . $\mathbf{14}_n$ associated with each cylinder of the engine. The designation "n"corresponds to the number of cylinders in the engine. Each ignition coil $\mathbf{12}_1$, $\mathbf{12}_2$, $\mathbf{12}_3$ . . . $\mathbf{12}_n$ has a respective primary winding $\mathbf{16}_1$, $\mathbf{16}_2$, $\mathbf{16}_3$ . . . $\mathbf{16}_n$ with a first end thereof configured for connection for a power source, designated $V_{BATT}$ in the drawings. Each coil $\mathbf{12}_1$, $\mathbf{12}_2$, $\mathbf{12}_3$, . . . $\mathbf{12}_n$ further includes a respective secondary winding $\mathbf{18}_1$, $\mathbf{18}_2$, $\mathbf{18}_3$ . . . $\mathbf{18}_n$ configured for connection to a respective one of the spark plugs $\mathbf{14}_1$, $\mathbf{14}_2$, $\mathbf{14}_3$ . . . $\mathbf{14}_n$ .

Apparatus 10 further includes a plurality of silicon-controlled rectifiers (SCRs) designated $\mathbf{20}_1$, $\mathbf{20}_2$, $\mathbf{20}_3$. . . $\mathbf{20}_n$. Each SCR 20 functions as a selector for determining which ignition coil 12 will carry primary current. Each SCR includes a respective anode terminal ("A"), cathode terminal ("K"), and gate terminal ("G"). Each SCR 20 is connected in-series with a corresponding primary winding (e.g., SCR $\mathbf{20}_1$ is connected in-series with primary winding $\mathbf{16}_1$, SCR $\mathbf{20}_2$ is connected in-series with primary winding $\mathbf{16}_2$, and so on). The anode terminal of each SCR 20 is connected to a second end of the primary winding 16 opposite the first end that is connected to $V_{BATT}$, the second end being designated $V_1$ in the Figures, and illustrated only on primary winding $\mathbf{16}_1$ for clarity. The cathode terminals of all of the SCRs 20, however, are connected to a common node, designated $V_c$– in FIG. 1. Each SCR 20 is controllable into conduction by a respective gating signal applied to a corresponding gate terminal "G". As illustrated, gating signal S1 is coupled to the gate terminal of SCR $\mathbf{20}_1$, gating signal S2 is connected to the gate terminal of SCR $\mathbf{20}_2$, gating signal S3 is connected to the gate terminal of SCR $\mathbf{20}_3$, and gating signal Sn is coupled to the gate terminal of SCR $\mathbf{20}_n$. Each SCR 20 may comprise conventional components well known to those of ordinary skill in the art, and may further comprise commercially available components such as, for example only, component model number MCR 218 available from Motorola Semiconductor Products (e.g., for an 8 ampere RMS component). The actual component specifications used for SCR 20 will depend on the contemplated level of primary current $I_p$ through a primary winding 16, the selected reverse blocking voltage, the designed trigger current required on the gate terminal for conduction, and other design criteria known to those of ordinary skill in the art.

Apparatus 10 further includes a main driver device 22 connected to the SCRs and configured to conduct a respective primary current $I_p$ in response to a drive signal $S_{DRIVE}$. In a preferred embodiment, the driver device is connected between the common node $V_c$– and ground. Drive signal $S_{DRIVE}$ independently controls the conduction or nonconduction of driver device 22. This is in contrast to the SCRs $\mathbf{20}_1$–$\mathbf{20}_n$. With an SCR, as known, current conduction will continue to occur through the device after it has started until the anode-to-cathode current goes to zero. Stated another way, an SCR cannot be independently turned off, for example, by adjustment of a voltage and/or a current level on the gate terminal. Therefore, while each SCR 20 is operative to select a corresponding one of the ignition coils, particularly primary windings $\mathbf{16}_1$, $\mathbf{16}_2$, $\mathbf{16}_3$ . . . $\mathbf{16}_n$ for conduction of primary current $I_p$ therethrough, at least one, in-series connected driver device 22 is required having independent control of conduction. The independent control is needed in order to interrupt the primary current $I_p$, thereby causing a spark, and in the process, allowing the primary current $I_p$ to go to zero (thereby turning the SCR off). Driver device 22, as illustrated, may be an insulated gate bipolar transistor (IGBT); however, it should be understood that such illustration is exemplary only and not limiting in nature. Driver device 22 may comprise alternative conventional components known to those of ordinary skill in the art, such as a bipolar transistor arranged in a darlington configuration.

Control circuit 24 is configured to generate the plurality of gating signals $S_1$, $S_2$, $S_3$ . . . $S_n$, and the drive signal $S_{DRIVE}$ responsive to one or more ignition control signals. The ignition control signal illustrated in FIG. 1 comprise at least one electronic spark timing (EST) signal. Control circuit 24 is thus configured to control the opening and closing of main driver device 22 by way of signal $S_{DRIVE}$, as well as selecting one of the SCRs $\mathbf{20}_1$, $\mathbf{20}_2$, $\mathbf{20}_3$ . . . $\mathbf{20}_n$ for conduction. As described below in greater detail, the gating signals are generated in timed-relation with the drive signal $S_{DRIVE}$. In one embodiment, the timing relationship is such that the main driver device is turned on at the same time as a selected one of the SCRs.

A vehicle control module, such as electronic control module (ECM) 26, is configured to generate one or more EST signals in accordance with known ignition control strategies. ECM 26 may generate an EST signal having transitions suitable for controlling all of the ignition coils $\mathbf{12}_1$, $\mathbf{12}_2$, $\mathbf{12}_3$ . . . $\mathbf{12}_n$, or may comprise a separate, individual EST line for each ignition coil $\mathbf{12}_1$, $\mathbf{12}_2$, $\mathbf{12}_3$ . . . $\mathbf{12}_n$ .

Figure 2:
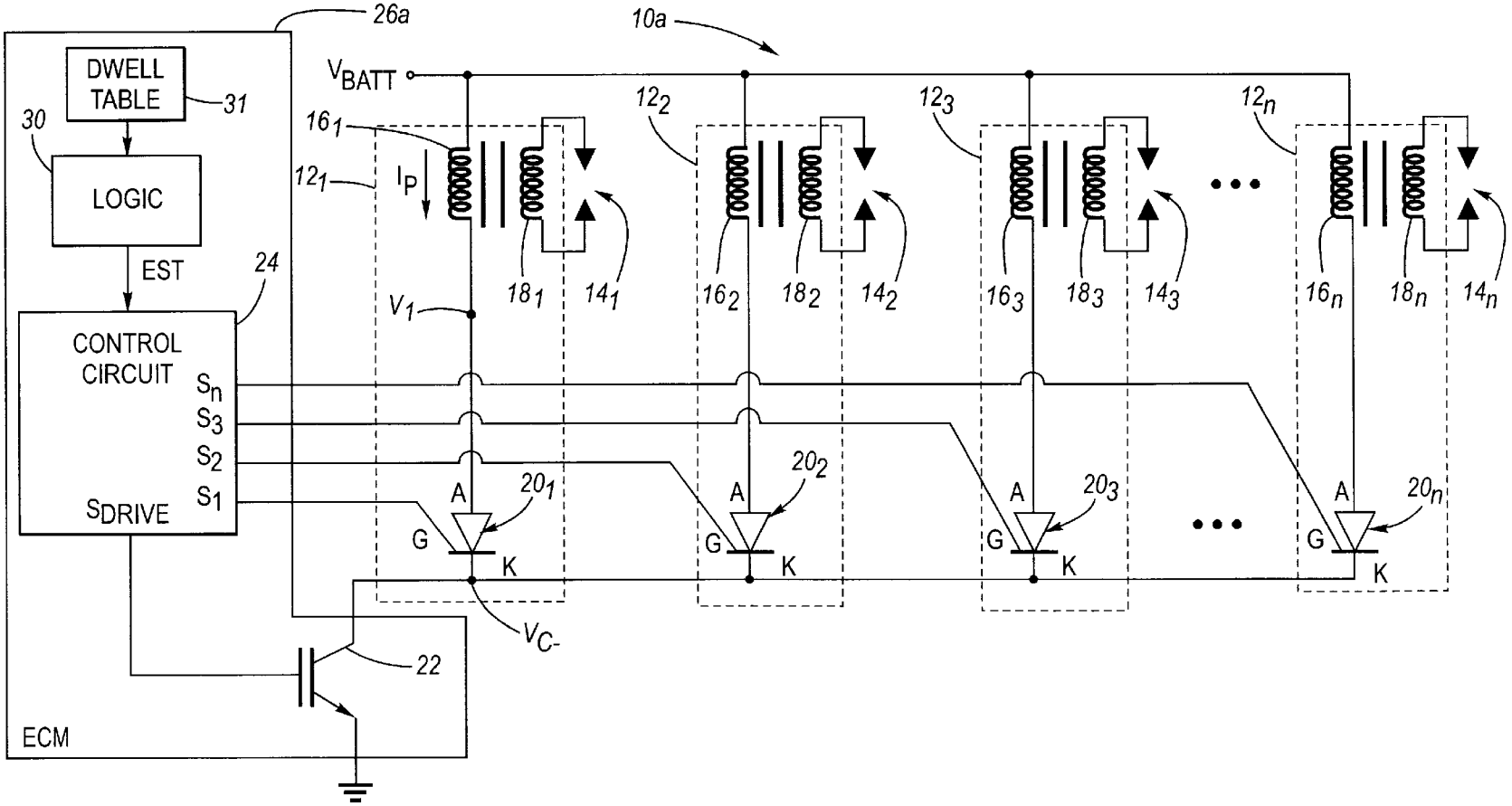
FIGS. 2A–2E are timing diagrams of an ignition control signal and multiple gating signals for use with the circuit of FIG. 1.

FIGS. 2A–2E show timing diagrams of the EST signal and the gating signals, while FIGS. 3A–3D show, in greater detail, electrical signals produced in apparatus 10. The operation of an embodiment according to the present invention will now be set forth. ECM 26, in accordance with a predetermined operating strategy, and based on a plurality of engine operating parameter inputs, among other things, determines when to assert the ignition control signal EST. The asserted ignition control signal EST is the command to commence charging a respective one of the ignition coils $\mathbf{12}_1$, $\mathbf{12}_2$, $\mathbf{12}_3$ . . . $\mathbf{12}_n$ for producing a spark event. Ignition control signal EST is applied, as shown in FIG. 2A, as a positive-going pulse having a duration corresponding to a desired primary ignition coil charge time. Charging commences at the time of receipt by control circuit 24 of the rising (positive-going) edge of the EST signal.

Control circuit 24, in response thereto, adjusts the control voltage of drive signal $S_{DRIVE}$, which causes main driver 22 to be placed in a conductive state. In addition, control circuit 24, in response to the asserted EST signal, generates a gating signal S1, shown as a pulse in FIG. 2B. In the illustrated embodiment, the gating signal S1 for ignition coil $\mathbf{12}_1$, is generated substantially, synchronously with the rising edge of the EST signal (where the EST signal contains pulses for all the coils). As shown in FIG. 3D, at time $t_1$ (i.e., at the rising edge of the EST signal), control circuit 24 selects SCR $\mathbf{20}_1$ (via signal S1), and enables drive device 22 for conduction. Thus, the primary current $I_p$, which is also shown in FIG. 3D, begins to rise, and may, in one embodiment, reach a peak electrical current level before the predetermined spark time arrives, and therefore be limited to a predetermined maximum level, as shown beginning at time $t_2$ . FIGS. 2B–2E collectively show a 1-3-4-2 cylinder firing sequence, inasmuch as the sequence of gating signals is S1, S3, S4 and S2.

As shown in FIG. 3C, the voltage level at the second end of primary winding $\mathbf{16}_1$, at node $V_1$, is generally at the level of the power source $V_{BATT}$ from time zero until time $t_1$. Once main driver device 22, and SCR $\mathbf{20}_1$ have been controlled into conduction, the voltage level at $V_1$ goes substantially to ground, as illustrated. FIG. 3A shows a similar voltage transition at the common node $V_{c-}$. FIG. 3B shows the gating signal S1, which controls SCR $\mathbf{20}_1$.

Upon receipt of a falling (negative-going) edge of the ignition control signal EST, control circuit 24 discontinues the drive signal $S_{DRIVE}$, which causes driver device 22 to open, thereby causing an interruption in the primary current $I_p$. In the described example (i.e., the first pulse of EST signal in FIG. 2A), the falling edge is understood to be of the EST pulse corresponding to ignition coil $\mathbf{12}_1$ . The time for interruption, indicated as time $t_3$ in FIGS. 3A–3D, is determined by ECM 26, and is communicated through the EST signal. It is well understood by those of ordinary skill in the art of ignition control that such interruption of primary current $I_p$ results in a relatively high voltage being immediately established across secondary winding $\mathbf{18}_1$, due to the collapsing magnetic fields associated with the interruption of the primary current. This large increase in voltage is shown in FIGS. 3A–3C for the common node $V_{c-}$, the gate terminal of the SCR, and at the coil end (i.e., $V_1$), respectively. The secondary voltage will continue to rise until reaching a breakdown voltage across the electrodes of spark plug $\mathbf{14}_1$. The spark current will thereafter discharge across the gap, as is generally understood in the art.

Once the primary current goes to zero (after time $t_3$ in FIG. 3D), SCR $\mathbf{20}_1$ will again assume a blocking function and will not allow current to flow therethrough without the appropriate gating pulse being applied on its gate terminal. As shown in FIGS. 2A–2C–2E, the foregoing process is repeated for cylinder 3, cylinder 4, and cylinder 2, as controlled through the generation of gating signals S3, S4, S2 in timed relation with drive signal $S_{DRIVE}$.

FIG. 4 shows a control circuit 24 suitable for use in a system where a separate, individual ignition control line that conducts a separate ignition control signal EST 1, EST 2, EST 3 . . . $EST_n$ is used. Each of the EST signals is used to control a particular one of the ignition coils. As shown in FIG. 4, control circuit 24 may include an OR-logic gate 28 having input terminals for receiving the ignition control signals EST 1, EST 2, EST 3 . . . ESTn and an output terminal on which the drive signal $S_{DRIVE}$ is generated.

Control circuit 24 is further configured to produce the gating signals S1, S2, S3 . . . Sn as a function of a corresponding one of the input ignition control signals EST1–ESTn. The arrangement illustrated in FIG. 4 is particularly useful when apparatus 10, including control circuit 24, is implemented in an ignition module associated with the coils that is configured to receive an individual EST signal for the control of each individual ignition coil.

Figure 5:
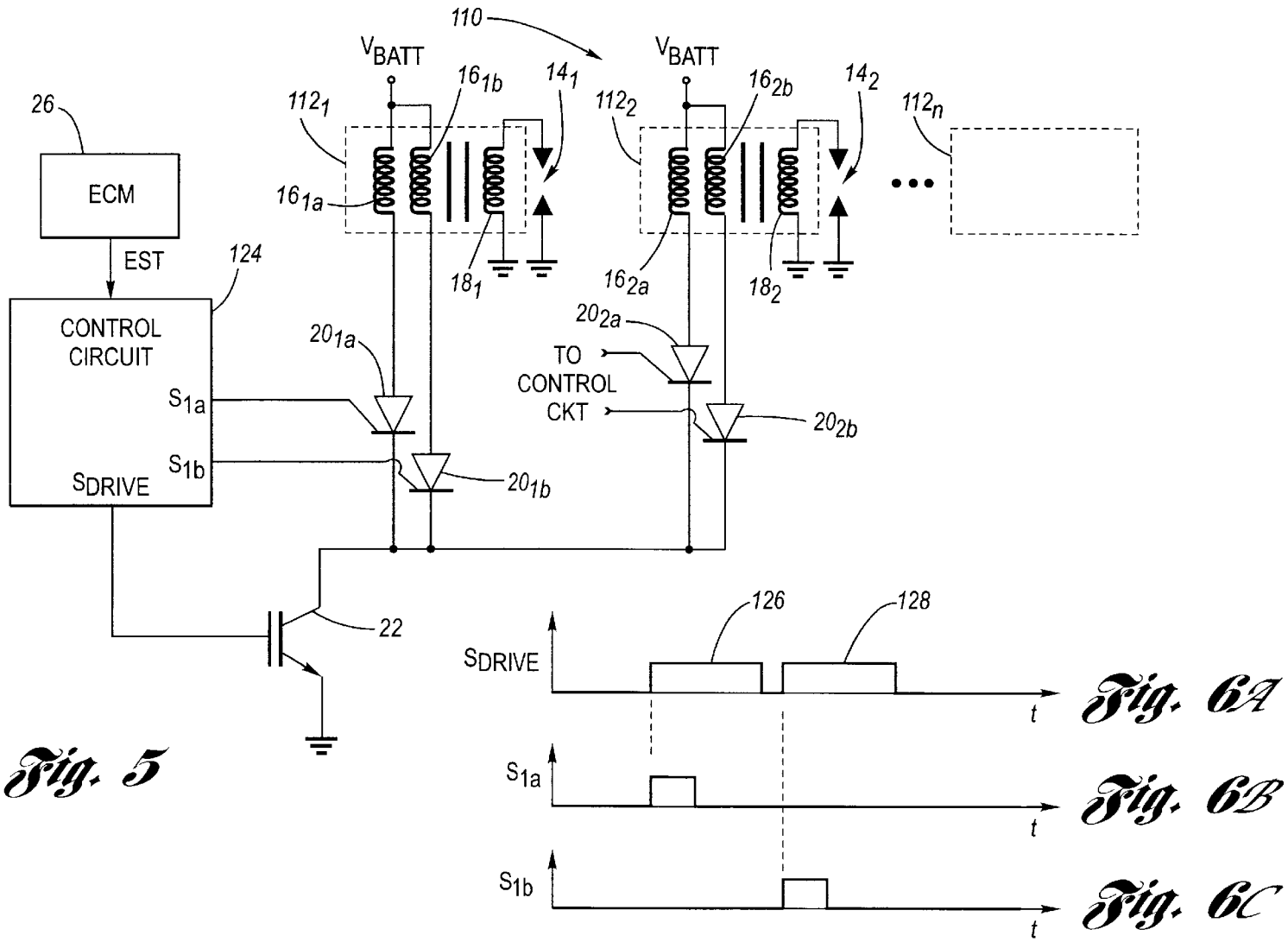
FIG. 5 is a simplified schematic and block diagram view of a second embodiment according to the present invention employing dual primary windings.

FIG. 5 shows an alternate apparatus 110 in accordance with the present invention. Unless otherwise stated, all reference numerals in FIG. 5 identify identical components in the various views. FIG. 5 illustrates a configuration where each ignition coil $\mathbf{112}_1$, $\mathbf{112}_2$, $\mathbf{112}_3$ . . . $\mathbf{112}_n$ includes multiple primary windings. As illustrated, ignition coil $\mathbf{112}_1$ includes a first primary winding $\mathbf{16}_{1a}$, and a second primary winding $\mathbf{16}_{1b}$. Ignition coil $\mathbf{112}_2$ includes a first primary winding $\mathbf{16}_{2a}$, and a second primary winding $\mathbf{16}_{2b}$. Other ignition coils $\mathbf{112}_n$, may be included, where n corresponds to the number of cylinders in the engine. An ignition system having the configuration illustrated in FIG. 5 has a number of advantages, as described in U.S. Pat. No. 5,886,476 issued to Skinner, et al., entitled "METHOD AND APPARATUS FOR PRODUCING ELECTRICAL DISCHARGES,"hereby incorporated by reference in its entirety; however, a drawback to a dual primary winding ignition system is the increased cost, due to the requirement that two driver devices be used to independently control each of the primary windings. Apparatus 110 according to the invention overcomes this drawback by employing SCRs $\mathbf{20}_{1a}$, and SCR $\mathbf{20}_{1b}$ in-series with primary windings $\mathbf{16}_{1a}$, and $\mathbf{16}_{1b}$, respectively. Control of each SCR $\mathbf{20}_{1a}$ and $\mathbf{20}_{1b}$, is accomplished by way of respective gating signals $S_{1a}$ and $S_{1b}$, as produced by control circuit 124.

FIGS. 6A–6C show exemplary timing diagrams for the drive signal $S_{DRIVE}$, and the gating signals $S_{1a}$ and $S_{1b}$. As illustrated, control circuit 124, responsive to assertion of an ignition control signal EST, is configured to produce first and second pulses 126, 128 per firing event per ignition coil. It should be understood that the waveforms shown in FIG. 6A–6C are repeated for each ignition coil for each firing event, in accordance with the control established by ECM 26. Second pulse 128 is spaced from first pulse 126. The first and second pulses 126, 128 are produced in timed relation with the first gating signal $S_{1a}$ and $S_{1b}$, respectively. In an illustrated embodiment, the rising edges of gating signals, $S_{1a}$ and $S_{1b}$ are aligned with the rising edges of the pulses 126 and 128, respectively.

FIG. 7 shows a third embodiment according to the invention, namely apparatus $\mathbf{10}_a$, where the main driver 22, and control circuit 24, are up-integrated into a vehicle control module, such as ECM $\mathbf{26}_a$. As shown, ECM $\mathbf{26}_a$ includes a logic unit 30 for general processing, which may comprise a CPU. ECM $\mathbf{26}_a$ also includes a dwell table 31 which includes spark timing and duration (dwell) data. The apparatus $\mathbf{10}_a$ is an extremely cost effective way to implement the electronics. For example, for a 4 cylinder engine, the user of the ECM would only have to integrate one main driver, instead of four (4). This approach would also save space in the ECM. The SCRs 20 may preferably be integrated into the ignition coils 12, as indicated by the surrounding dashed-line boxes in FIG. 7. In an alternate embodiment, the SCRs may be integrated into the ECM $\mathbf{26}_a$. In the former arrangement (i.e., SCRs in the ignition coils), the ECM may be configured to provide the trigger pulses via the included control circuit 24. In one, preferred embodiment, the drive signal $S_{DRIVE}$ generated by ECM $\mathbf{26}_a$ comprises a variable pulse width signal. This may be generated by logic 30, using dwell table 31, in combination with control circuit 24. On the other hand, the trigger pulses $S_1$, $S_2$ . . . Sn etc. may comprise fixed pulse width signals (i.e., that is all the SCR requires), and which require less circuitry and is thus lower in cost. In all other regards, apparatus $\mathbf{10}_a$ may be configured and operated the same as apparatus 10.

Figure 8:
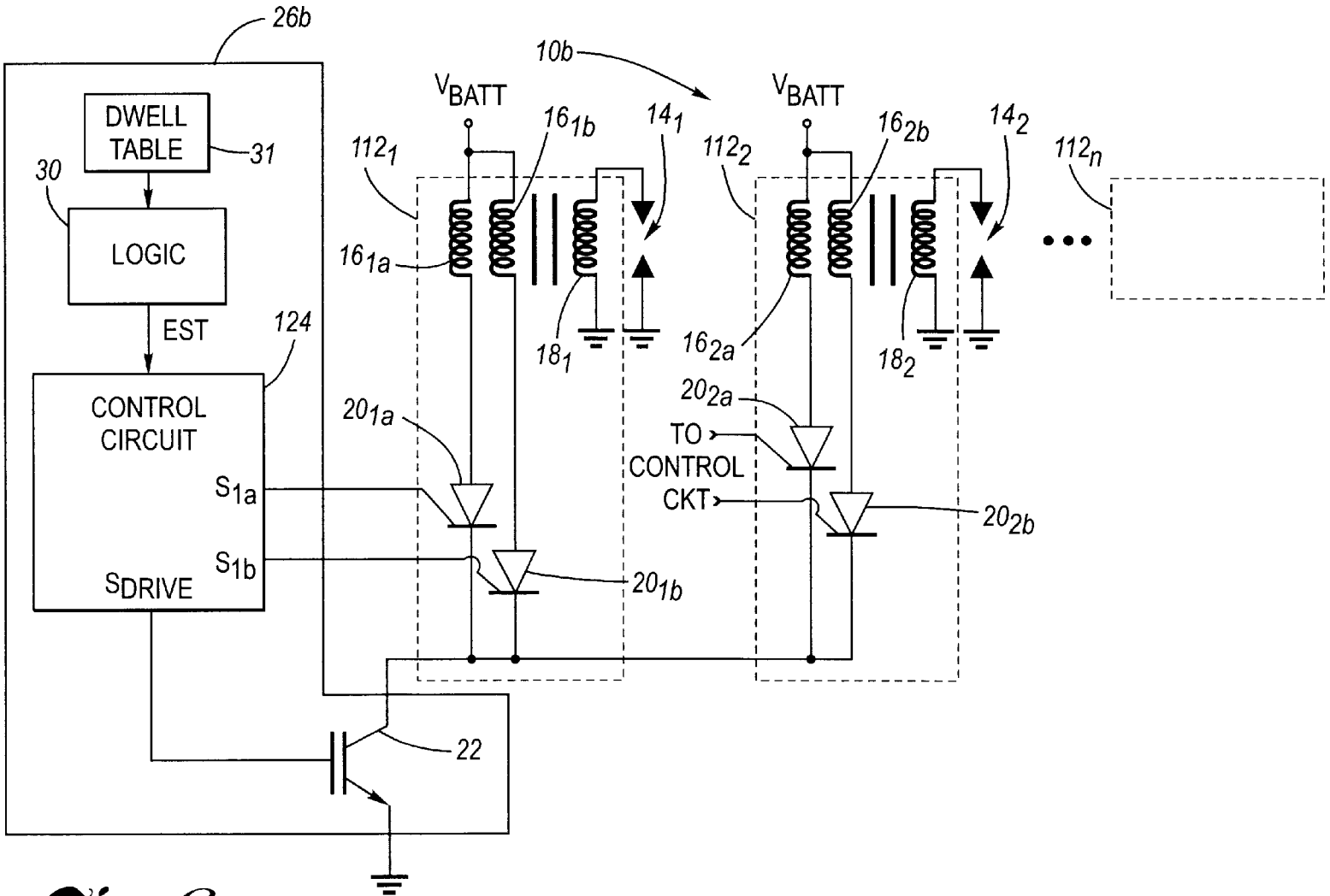
FIG. 8 is a simplified schematic and block diagram view of a fourth embodiment according to the invention, having dual primary windings, with the main driver integrated with an ECM.

FIG. 8 shows a fourth embodiment according to the invention, namely apparatus $\mathbf{10}_b$. Apparatus $\mathbf{10}_b$ is like apparatus 110 in FIG. 5, except that (i) the main driver 22 and the control circuit 124 have been up-integrated into the ECM $\mathbf{26}_b$, and (ii) the SCRs (e.g., $\mathbf{20}_{1a}$ and $\mathbf{20}_{1b}$) have been integrated into the ignition coils (shown by surrounding dashed-line box). The operation of apparatus $\mathbf{10}_b$ is the same as apparatus 110, but includes the advantages of the apparatus $\mathbf{10}_a$.

An apparatus in accordance with the present invention employs an SCR for each coil to select which coil is allowed to conduct current when the main driver is turned on. The invention allows the use of a single driver device in combination with multiple SCRs as selectors, thereby reducing both the component cost of the drive circuit, as well as providing manufacturing advantage (e.g., less components need to be assembled). Each SCR acts as a current block for a reverse battery condition, which allows the use of a darlington device as the main driver device without having to add, as conventional, a diode in-line with the power supply rail for reverse battery protection. In alternate embodiments, use of the SCR allows the removal of a voltage clamp on the driver, which might be implemented employing a zener diode having its anode connected to the driver device emitter and having its cathode connected to the driver device collector. In still further embodiments, the main driver and the control circuit are integrated up into a vehicle control module, such as engine control module (ECM), while the SCRs are (preferably) integrated with the ignition coils.

What is claimed is:

1. An apparatus for an inductive ignition system having a plurality of ignition coils each with a primary winding, said apparatus comprising:

a respective silicon-controlled rectifier (SCR) connected to each primary winding and controlled into conduction by a respective gating sigmal;

a driver device connected to the silicon-controlled rectifiers and configured to conduct a respective primary current in response to a drive signal;

a control circuit configured to generate said Bating signals and said drive signal, wherein said control circuit is responsive to an ignition control signal for generating said gating signals and said drive signal;

wherein said ignition control signal controls production of a spark voltage on a secondary winding of each ignition coil, said ignition control signal comprising a plurality of electronic spark timing (EST) signals, said control circuit including an OR-logic gate having an output terminal on which said drive signal is generated responsive to said EST signals, said control circuit further including second output terminals on which said gating signals are produced.

2. An apparatus comprising:

a coil-per-plug inductive ignition system for a multiple cylinder internal combustion engine having an individual ignition coil associated with each engine cylinder, each ignition coil having a primary winding for conducting a primary current, said primary winding having a first end configured for connection to a power source and a second end, each ignition coil further having a secondary winding configured for connection to a respective spark plug, each coil further having a silicon-controlled rectifier (SCR), each SCR having an anode terminal connected to said second end of said primary winding, a cathode terminal connected to a common node, and a gate terminal, each SCR being controllable into conduction by a respective gating signal received on said gate terminal;

a vehicle control module remote from said ignition system including (i) a driver device including a collector terminal coupled to said common node, an emitter terminal coupled to a ground node, and a gate terminal for receiving a drive signal configured to cause said driver device to conduct said primary current; and (ii) a control circuit configured to generate said gating signals and said drive signal;

wherein each ignition coil has a first and a second primary winding for conducting said primary current, each of said first and second primary windings having a first end configured for connection to a power source and a second end coupled to a respective SCR, each SCR being controllable into conduction by a respective gating signal;

said control circuit being configured to generate said gating signals and said drive signal comprising a first pulse and a second pulse spaced therefrom for controlling a corresponding firing event;

wherein when said first pulse is generated, said control circuit is further operative to generate a corresponding gating signal for a first one of said SCRs that is coupled to said first primary winding; and wherein when said second pulse is generated, said control circuit is further operative to generate a further gating signal for a second one of said SCRs that is coupled to said second primary winding.

* * * * *